United States Patent [19]

Turnblom

[11] 4,106,934

[45] Aug. 15, 1978

[54] PHOTOCONDUCTIVE COMPOSITIONS AND ELEMENTS WITH CHARGE TRANSFER COMPLEXES

[75] Inventor: Ernest W. Turnblom, Rochester, N.Y.

[73] Assignee: Eastman Kodak Company, Rochester, N.Y.

[21] Appl. No.: 695,350

[22] Filed: Jun. 14, 1976

[51] Int. Cl.[2] ..... G03G 5/06; G03G 5/09

[52] U.S. Cl. ..... 96/1.5 R; 96/1.6

[58] Field of Search ..... 96/1.5; 252/501

[56] References Cited

U.S. PATENT DOCUMENTS

| | | | |
|---|---|---|---|
| 3,037,861 | 6/1962 | Hoegl et al. | 96/1.5 |
| 3,287,114 | 11/1966 | Hoegl | 96/1.5 |
| 3,615,414 | 10/1971 | Light | 96/1.6 |
| 3,647,432 | 3/1972 | Holstead | 96/1.5 |
| 3,655,378 | 4/1972 | Contois et al. | 96/1.5 |
| 3,764,315 | 10/1973 | Mort et al. | 96/1.5 |
| 3,923,762 | 12/1975 | Stolka et al. | 96/1.5 |
| 4,013,623 | 3/1977 | Turner et al. | 96/1.5 X |

OTHER PUBLICATIONS

Japanese Patent Publ., J5 0017-234.

*Primary Examiner*—Roland E. Martin, Jr.
*Attorney, Agent, or Firm*—Ronald P. Hilst

[57] ABSTRACT

A photoconductive insulating composition containing (a) one or more p-type organic photoconductor components and (b) a charge transfer complex of one or more electron acceptor components and one or more electron donor components, the electron donor components being selected from materials having one of the following formulas:

I.

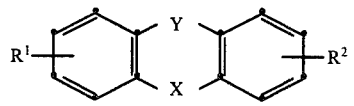

II.

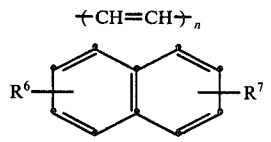

III.

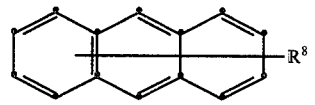

wherein

*n* represents 0, 1 or 2; X represents oxygen, sulfur, selenium or the groups $>CR^3R^4$ or $>C{=}CR^5R^6$; Y represents a single covalent chemical bond or the necessary carbon and hydrogen atoms to complete a 6 to 9 member saturated or unsaturated ring; and each of $R^1$ through $R^8$ represents a substituent group such that the resultant material forms a charge-transfer complex with 2,4,7-trinitro-9-fluorenone.

18 Claims, No Drawings

PHOTOCONDUCTIVE COMPOSITIONS AND ELEMENTS WITH CHARGE TRANSFER COMPLEXES

FIELD OF THE INVENTION

This invention relates to electrophotography and in particular to photoconductive compositions and elements useful in electrophotographic processes and apparatus.

BACKGROUND OF THE INVENTION

The process of xerography, as disclosed by Carlson in U.S. Pat. No. 2,297,691, employs an electrophotographic element comprising a support material bearing a coating of an insulating material whose electrical resistance varies with the amount of incident electromagnetic radiation it receives during an imagewise exposure. The element, commonly termed a photoconductive element, is first given a uniform surface charge, generally in the dark after a suitable period of dark adaptation. It is then exposed to a pattern of activating radiation, such as visible light or X-rays, which has the effect of differentially reducing the potential of the surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner, whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor or the like, or transferred to a second element to which it can similarly be fixed. Likewise, the electrostatic charge pattern can be transferred to a second element and developed there.

Various photoconductive insulating materials have been employed in the manufacture of electrophotographic elements. For example, vapors of selenium and vapors of selenium alloys deposited on a suitable support and particles of photoconductive zinc oxide held in a resinous, film-forming binder have found wide application in present-day electrophotographic document copying processes.

Since the introduction of electrophotography, a great many organic compounds have also been screened for their photoconductive properties. As a result, a large number of organic compounds have been known to possess some degree of photoconductivity. Many organic compounds have revealed a useful level of photoconduction and have been incorporated into photoconductive compositions. Among the various reasons for the increasing interest in the investigation of organic materials as photoconductors for typical photoconductive elements used in electrophotographic processes is that many of these materials are optically clear in addition to having desirable electrophotographic properties. Therefore, such materials can be used as a transparent coating adhered to a suitable support in an electrophotographic apparatus. Because of this transparency property of many organic photoconductive materials one attains additional flexibility in equipment design, i.e., one has the option of exposing such transparent materials from either the top surface of the material coated on a suitable support or, if the support is also transparent, one can expose through the support onto the bottom surface of the material.

One particular organic photoconductive composition which has received considerable interest in the art is an organic photoconductive composition composed of a charge transfer complex consisting of approximately equal molar amounts of a polymerized vinyl carbazole compound and a material which is an electron acceptor for the vinyl carbazole compound, such as 2,4,7-trinitro-9-fluorenone (often referred to in the art and hereafter in the present application as TNF). Further description of this particular photoconductive material and various background patent literature relating thereto may be found in Shattuck et al U.S. Pat. No. 3,484,237 issued Dec. 16, 1969; Hoegl U.S. Pat. No. 3,037,861 and Hoegl Canadian Pat. No. 690,972 issued July 21, 1964.

The materials described in the foregoing patent literature have received extensive attention and investigation, particularly the photoconductive compositions composed of a mixture of polyvinyl carbazole and TNF, and have been used in commercial electrophotographic office-copier equipment. In addition, much work has been carried out to further improve, modify and, in fact, replace one or both of the materials used in such charge-transfer complex photoconductive compositions to obtain improvements in the performance of these compositions in electrophotographic imaging processes. In particular, such work has been done to find and develop other types of photoconductive charge-transfer compositions which exhibit increased sensitivity to activating radiation so that the resultant photoconductive composition can be used in higher speed electrophotographic copy duplicating equipment or can be used in conventional speed electrophotographic equipment together with less intense exposure sources.

In this regard, Contois et al U.S. Pat. No. 3,655,378 issued Apr. 8, 1972 describes a photoconductive composition composed of a charge-transfer complex of a Lewis acid, such as TNF and, instead of a polyvinyl carbazole resin, a resin formed by the condensation of dibenzothiophene with formaldehyde or a resin formed by the condensation of formaldehyde and dibenzofuran. Organic photoconductive compositions containing such charge-transfer complexes exhibit useful levels of light-sensitivity generally equal or comparable to that obtained by charge-transfer complex photoconductive compositions composed of polyvinyl carbazole and TNF. In addition, it was found that the sensitivity of the resultant charge-transfer complex organic photoconductive compositions described in U.S. Pat. No. 3,655,378 could be enhanced by the addition of relatively small amount of various sensitizing dyes and/or chemical sensitizers, including certain materials previously known in the art as organic photoconductors, for example, tris(p-tolyl)amine.

Although the various organic charge-transfer complex photoconductive compositions such as those described in Contois et al U.S. Pat. No. 3,655,378 and Shattuck et al U.S. Pat. No. 3,484,237, referenced hereinabove have been found quite useful, further research activity has gone on in the art to find even further improvements and modifications of such materials. In particular, extensive efforst has been devoted to find compositions exhibiting increased light sensitivity so that certain charge-transfer complex containing compositions can be used in higher speed electrophotographic processes.

SUMMARY OF THE INVENTION

In accordance with the present invention, there is provided a photoconductive insulating composition comprising an organic p-type photoconductor and a charge-transfer complex of at least one electron donor selected from formulas I–III below and at least one organic electron acceptor for said donor.

I.

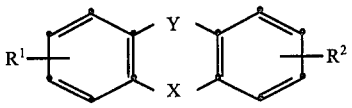

II.

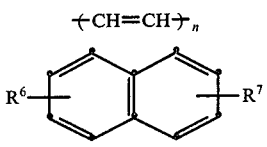

III.

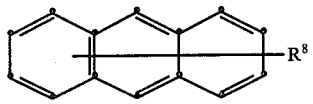

In formulas I–III, $n$ represents 0, 1 or 2; X represents oxygen, sulfur, selenium or the groups $>CR^3R^4$ or $>C{=}CR^5R^6$; Y represents a single covalent bond or the necessary carbon and hydrogen atoms to complete 6 to 9 member saturated or unsaturated ring; and each of $R^1$–$R^8$ represents a substitutent group such that the resultant material is capable of forming a charge-transfer complex with 2,4,7-trinitro-9-fluorenone.

In accordance with the various embodiments of the present invention, the photoconductive insulating composition of the invention may be present in a conventional photoconductive element having a support, preferably a conducting support or a support bearing a layer of a conducting material, the support being overcoated with a single layer of a photoconductive composition comprising the material of the present invention.

In accord with still other embodiments of the invention, it has been found useful to incorporate the photoconductive insulating compositions of the present invention as the light sensitive charge generating layer of "multi-active-layer" photoconductive insulating elements, i.e., elements having a photoconductive composition containing more than one active layer. Typically, such "multi-active" elements have at least two active layers contained therein, namely a light-sensitive charge generating layer capable of generating charge carriers, i.e., photoelectrons or positive hole carriers, and a charge transport layer containing one or more materials capable of accepting and transporting the charge carriers injected therein from the charge-generating layer of the element.

In accord with a further embodiment of the invention, it has been found that the photoconductive compositions of the present invention may be incorporated in a "heterogeneous" or "aggregate" multiphase photoconductive composition of the type described in Light U.S. Pat. No. 3,615,414 issued Oct. 26, 1971 and Gramza et al U.S. Pat. No. 3,732,180. Advantageously, it has been found that many of the photoconductive compositions of the present invention are photosensitive to visible light in the 400 to 500 nm region of the spectrum. Accordingly, when such compositions of the present invention are incorporated in the above-referenced aggregate photoconductive compositions, it has been found that one can enhance the sensitivity of these compositions to light in the 400 to 500 nm spectral region thereby resulting in photoconductive compositions exhibiting increased pan sensitivity. In addition, it has been found that the photoconductive compositions of the invention can enhance the transport of photogenerated charge carriers through certain aggregate photoconductive compositions. The compositions of the invention may be employed in both conventional single-layer aggregate photoconductive compositions or multi-active layer aggregate photoconductive compositions as described in Berwick et al, U.S. patent application Ser. No. 639,039 filed Dec. 9, 1975.

DESCRIPTION OF THE PREFERRED EMBODIMENTS

As indicated previously hereinabove, the electron donor materials useful in the present invention may be selected from structural formulas I–III illustrated above. The substituents, i.e., $R^1$–$R^8$ of formulas I–III, in general, may be selected from a wide variety of chemical substituents, including but not limited to the following substituents: hydrogen, halo, nitro, cyano, substituted and unsubstituted aliphatic, alicyclic and aromatic groups, and groups forming bridged and fused ring structures with the ring systems present in formulas I–III. An exhaustive listing of individual such substituents is not possible herein and is considered unnecessary. The important criteria for selecting chemical groups which are appropriate as substituents $R^1$–$R^8$ is that the resultant substituted compound be capable of forming a charge-transfer complex with electron acceptors representative of those useful in the present invention, such as 2,4,7-trinitro-9-fluorenone.

To evaluate the capability of a given material having formulas I–III represented hereinabove to form a charge-transfer complex with 2,4,7-trinitro-9-fluorenone (and therefore predict whether or not a particular compound has utility in the present invention) one can carry out the following relatively simple test:

CHARGE-TRANSFER FORMATION TEST

A solvent mixture is prepared containing 1 mole of 2,4,7-trinitro-9-fluorenone for each 1 mole of the specific electron donor material to be tested, i.e., a compound selected from the group represented by formulas I–III illustrated above. The solvent chosen for this equimolar mixture is a common solvent for both the 2,4,7-trinitro-9-fluorenone (TNF) and the particular compound under consideration. In addition, the solvent should be a non-interfering solvent, i.e., a solvent incapable of reacting chemically with either the TNF or the compound under consideration or of itself exhibiting the capability of forming a charge-transfer complex with either the TNF or the electron donor material under consideration. In addition to this equimolar solvent mixture of TNF and electron donor material, two individual control mixtures are prepared, one control being a mixture of TNF and solvent in the absence of any electron donor material and the other control being a mixture of the electron donor material and solvent in the absence of any TNF. Whether or not the particular electron donor material under consideration exhibits the capability of charge-transfer complex formation with the TNF can then be evaluated quite simply by comparing the absorption band spectrum of each of the three above-described solvent mixtures. If charge-transfer complex formation occurs, the test solvent mixture consisting of TNF, the compound under consideration and solvent will exhibit a new characteristic absorption band as evidenced, for example, by a visual color change, in a region of the spectrum in which neither of the individual control mixtures of TNF and solvent or electron donor material and solvent exhibit any absorption peak.

By use of the above-described charge-transfer complex formation test, one can determine whether or not a particular substituent under consideration is an appropriate substituent for the compounds represented by structural formulas I–III above. It should be appreciated in connection with the above-described charge-transfer formation test that it is possible for a given substituent to be suitable for one or two of structural formulas I–III, but not each of structural formulas I–III.

In accord with certain preferred embodiments of the present invention wherein especially good results have been obtained, it has been found that materials having the following structural formula are particularly useful as formula I type compounds:

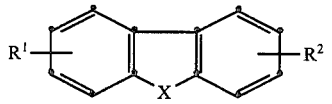

wherein each of $R^1$ and $R^2$, which may be the same or different, represent hydrogen, halogen, or nitro and X represents sulfur, oxygen, or a group having one of the following formulas:

$$>CR^3R^4 \qquad \text{IV.}$$

$$>C{=}CR^5R^6 \qquad \text{V.}$$

wherein $R^3$, $R^4$ and $R^5$ represent hydrogen and $R^6$ represents a nitro-substituted aryl typically having 6 to 14 carbon atoms in the aryl ring, e.g., a nitrophenyl group.

Similarly, it has been found that as materials useful as formula II type compounds particularly good results can be obtained from materials having the following formula:

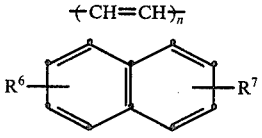

wherein $R^6$ and $R^7$ represent hydrogen and $n$ represents 0 or 1.

Likewise, when a material possessing structural formula III represented hereinabove is selected for use in the present invention, it has been found that particularly good results can be obtained from compounds having the following formula:

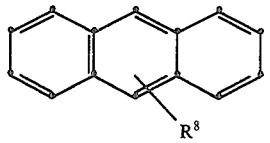

wherein $R^8$ represents nitro, cyano or lower alkyl groups having 1 to 4 carbon atoms such as methyl or isopropyl.

And, yet another material possessing structural formula I above which has been found to provide especially good results when used in the present invention is a compound having the following formula:

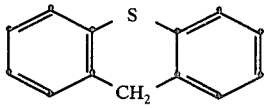

The materials selected for use in accord with the present invention as electron acceptor materials can be chosen from a wide variety of known such organic or organo-metallic materials. Typically, these materials are organic, including organo-metallic, materials which are colorless or have a low degree of coloration. Typically, the absorption maxima of these materials is in the ultraviolet region of the spectrum, generally below about 450 nm. The electron acceptor materials found useful in the present invention may be selected from a wide variety of known such materials which previously have been used in various types of photoconductive compositions and therefore are well known in the art. For example, a variety of such electron acceptor materials are described in Hoegl U.S. Pat. No. 3,037,861 and Hoegl Canadian Pat. No. 690,972, and the materials disclosed in the foregoing Hoegl patents is hereby incorporated by reference in the present specification.

It will be appreciated that the term "electron acceptor", as generally used in the chemical arts, is a relative term used to define a class of materials which possesses electron accepting properties with respect to one or more different materials which, relative to the particular electron acceptor compound under consideration, exhibit electron donating properties. Thus, whether a given material is in fact an electron acceptor depends upon the particular compound or standard one is using as an electron donor for purposes of comparison. The electron donor materials used in the present invention have a defined chemical structure as represented by formulas I–III illustrated hereinabove. Thus, it will be understood that the term "electron acceptor" as used herein, has reference to those materials which possess electron accepting properties relative to one or more specific electron-donor materials within the class of materials defined by formulas I–III presented earlier herein.

In addition to 2,4,7-trinitro-9-fluorenone, a partial listing of other representative materials which are considered to possess useful electron acceptor properties relative to one or more of the electron donor compounds useful in the present invention is as follows: 2,4,5,7-tetranitro-9-fluorenone; 1,3,7-tri-nitrodibenzothiophene sulfone; 3,7-di-nitrodibenzothiophene sulfone; 3,3',5-trinitrobenzophenone; tetracyanopyrazine; 2,6,8-trinitro-4H-inden(1,2-b)thiophen-4-one; tetracyanopyrazine; 2,6-dichloro-p-benzoquinone; 2,5-dinitro-9-fluorenone; 1,5-dichloro-2,4-dinitrobenzene; 2,5-dichloro-p-benzoquinone; tetrachlorobenzoquinone; 2-chloro-3,5-dinitropyridine; 2,4,5,7,9-pentanitroindeno[2,1-a]fluoren-11,12-dione; 2,5-diphenyl-p-benzoquinone; and 9-dicyanomethylene-2,4,7-trinitrofluorenone. Another particularly useful class of electron acceptor compounds useful in the present invention are the carboxy 9-dicyanomethylene nitrofluorenes as described in further detail in Sulzberg et al U.S. Pat. No. 3,637,798 dated Jan. 25, 1972. In addition to the compounds specifically listed as electron-acceptor materials hereinabove and which are considered to be useful in the present invention, it will be appreciated, from the long list of such materials asserted to possess at least some useful electron-acceptor properties in known organic photoconductive compositions (as shown in the above-identified Hoegl patents), that there are a variety of other electron acceptor materials which may be useful in accord with the present invention.

In accord with certain preferred embodiments of the present invention, the electron acceptor material employed is a monomeric material, typically having a molecular weight in the range of from about 100 to about 700; preferably 250 to about 550. However, it is to be understood that various polymeric electron acceptors may also be useful. For example, various polymers containing one or more repeating units derived from a monomeric electron acceptor compound may be employed. Such electron acceptor polymers are known in the literature; see, for example, "Charge Transfer in Donor Polymer-Acceptor Polymer Mixtures", by Sulzberg and Cotter, *Macromolecules,* I, No. 6, November–December 1968, pages 554 and 555.

The various p-type organic photoconductor materials which have been found useful in the present invention in combination with the above-described electron-donor and electron-acceptor material can be selected from a variety of known such photoconductor materials. Especially useful in accord with certain highly preferred embodiments of the invention are monomeric p-type organic photoconductor materials having in the molecular structure thereof one or both of the following organic groups typically referred to in the art as arylamine groups and polyarylalkane groups, respectively. These materials provide compositions of this invention having especially high light sensitivity properties. Still another group of p-type organic photoconductor materials useful in the present invention are the various pyrrole organic photoconductors such as described in Stumpf et al U.S. Pat. No. 3,174,854, issued Mar. 1965 and Fox U.S. Pat. No. 3,485,625, issued Dec. 23, 1969.

A partial listing of specific p-type arylamine-containing organic photoconductors includes diarylamines, the particular non-polymeric triphenylamines illustrated in Klufel et al, U.S. Pat. No. 3,180,730 issued Apr. 27, 1965; the triarylamines having at least one of the aryl radicals substituted by either a vinyl radical or a vinylene radical having at least one active hydrogen-containing group as described in Brantley et al U.S. Pat. No. 3,567,450 issued March 2, 1971; the triarylamines in which at least one of the aryl radicals is substituted by an active hydrogen-containing group as described in Brantley et al U.S. Pat. No. 3,658,520 issued Apr. 25, 1972; tritolylamine; and various polymeric arylamine-containing photoconductors such as those described in Fox U.S. Pat. No. 3,240,597, issued Mar. 15, 1966 and Merrill et al U.S. Pat. No. 3,779,750, issued Dec. 18, 1973.

Among the various specific polyarylalkane photoconductor materials which may be used in accordance with the present invention are the polyarylalkane materials such as those described in Noe et al U.S. Pat. No. 3,274,000 issued Sept. 20, 1966; Wilson U.S. Pat. No. 3,542,547 issued Nov. 24, 1970; Seus et al U.S. Pat. No. 3,542,544 issued Nov. 24, 1970; Rule U.S. Pat. No. 3,615,402 issued Oct. 26, 1971; Rule U.S. Pat. No. 3,820,989 issued June 28, 1974; and *Research Disclosure,* Vol. 133, May 1975, pages 7–11, entitled "Photoconductive Composition and Elements Containing Same". Preferred polyarylalkane photoconductive materials useful in the present invention can be represented by the formula:

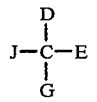

wherein D and G, which may be the same or different, represent aryl groups and J and E, which may be the same or different, represent a hydrogen atom, an alkyl group, or an aryl group, at least one of D, E and G containing an amino substituent. An especially useful polyarylalkane photoconductor which may be employed in the present invention is one having the formula noted above wherein J and E represent a hydrogen atom, an aryl group, or an alkyl group and D and G represent substituted aryl groups having as a substituent thereof a group represented by the formula:

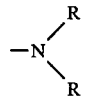

wherein R represents an unsubstituted aryl group such as phenyl or an alkyl substituted aryl such as a tolyl group. Additional information concerning the above-described preferred polyarylalkane photoconductors can be found by reference to the foregoing U.S. patents.

A partial listing of representative p-type photoconductors useful in the present invention is presented hereinafter as follows:

1. tris-(p-tolyl)amine;
2. bis(4-diethylamino-2-methylphenyl)phenylmethane;
3. bis(4-diethylaminophenyl)diphenylmethane;
4. 4-(di-p-tolylamino)-4'-[4-(di-p-tolylamino)-β-styryl]stilbene;
5. 2,3,4,5-tetraphenylpyrrole; and
6. 1,1-bis(4-di-p-tolylaminophenyl)cyclohexane.

In preparing photoconductive compositions of the present invention, it is important to maintain the proper molar amount of each of the various components essential to the photoconductive materials of the present invention. In this regard, it has generally been found that approximately equal molar amounts of each of the three required components namely (1) the electron donor, (2) the electron acceptor, and (3) the p-type photoconductor, yield photoconductive materials of the invention having optimum performance capabilities. Moreover, it has been found, as suggested above, that when too little or too much of a particular component making up the material of the present invention is used, the resultant material exhibits inferior photoconductive properties. For this reason, it has been found that with the sum total of the three required components of the photoconductive materials of the invention that is, the electron-donor component, the electron-acceptor component, and the p-type photoconductor equal to 100 mole percent, the amount of each individual component is optimally about 33 mole percent, but typically may vary from about 10 to about 65 mole percent. It should be understood, of course, that more than one specific material may represent the total amount of each of the above required components used in the photoconductive materials of the invention. For example, the total amount of the electron-donor component used in the material of the invention may consist of one, two, or more individual electron-donor materials. Similarly, more than one electron acceptor or p-type photoconductor can also be present in the compositions of the invention. It will, of course, be appreciated that the above-noted compositional range (expressed in terms of mole percentage values) for the photoconductive compositions of the invention are applicable to monomeric electron acceptor, electron donor and p-type photoconductor materials. If polymeric acceptors or p-type photoconductor materials are employed in the present invention, the appropriate amounts of such polymeric materials to be used can be calculated by determining the moles of active acceptor or photoconductor units present based on an average acceptor or photoconductor polymer present in the particular composition under consideration.

An electrically insulating binder component can also be present in the photoconductive compositions of the present invention. Preferred binders for use in preparing the photoconductive composition of the present invention are film-forming, hydrophobic polymeric binders having fairly high dielectric strength and good electrical insulating properties. A partial listing of representative such materials includes vinyl resins, natural resins including gelatin, cellulose ester derivatives, cellulose nitrate, and the like; poly condensates including poly esters and polycarbonates; silicone resins; alkyd resins including styrene-alkyd resins and the like; paraffin; and various mineral waxes; etc. A further listing of specific polymeric materials useful as binders may be found in *Research Disclosure,* Vol. 109, pages 61–67, entitled "Electrophotographic Elements, Materials and Processes".

In general, the amount of binder present in the photoconductive compositions of the present invention may vary. Typically, useful amounts of the binder lie within the range of from about 10 to about 90% by weight based on the total weight of the mixture of photoconductive material and binder.

Sensitizing compounds, such as various sensitizing dyes and the like addenda, can also be incorporated in the photoconductive compositions of the invention, if desired, to increase the sensitivity or extend the spectral sensitivity range of the photoconductive compositions of the invention. However, one advantage of the compositions of the present invention is that many of these compositions exhibit relatively high sensitivity to visible light without the use of any additional sensitizing addenda.

The photoconductive compositions of the present invention are typically coated from organic solvent mixture containing the binder and the photoconductor components therein. The resultant mixture is coated, sprayed, etc., on a suitable support to form a resultant photoconductive element useful in various electrophotographic imaging processes. Typical solvents useful for preparing such photoconductive coating compositions of the present invention can include a wide variety of organic solvents for the various components used in the coating composition. Typical solvents include: aromatic hydrocarbon such as benzene, etc., including substituted aromatic hydrocarbons such as toluene, xylene, mesitylene, etc.; ketones such as acetone, 2-butanone, etc.; halogenated aliphatic hydrocarbons such as methylene chloride, chloroform, ethylene chloride, etc.; ethers, including cyclic ethers such as tetrahydrofuran, diethyl ether; mixtures of any of the foregoing solvents; and the like. If desired, the donor-acceptor complex used in the compositions of the present invention can be individually prepared and isolated (in the absence of p-type photoconductor) and then added to a particular coating composition together with the p-type photoconductor when it is desired to prepare the photoconductive compositions of the invention.

Suitable supporting materials on which the photoconductive insulating layers of this invention can be coated include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as chromium, silver, nickel, aluminum and the like coated on paper or conventional photographic film bases such as cellulose acetate, polystyrene, etc. Such conducting materials as nickel and chromium can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are described in Trevoy U.S. Pat. No. 3,245,833 issued Apr. 12, 1966 and in Rasch U.S. Pat. No. 3,880,657, issued Apr. 29, 1975. Likewise, a suitable conducting coating can be prepared from the sodium salt of a carboxyester lactone of maleic anhydride and a vinyl acetate polymer. Such kinds of conducting layers and methods for their optimum preparation and use are disclosed in Minsk U.S. Pat. No. 3,007,901 issued Nov. 7, 1961 and Sterman et al U.S. Pat. No. 3,262,807 issued July 26, 1966.

Coating thicknesses of the photoconductive compositions of the invention on a suitable support can vary widely. Normally, a coating in the range of about 10 microns to about 300 microns before drying is useful for the practice of this invention. The preferred range of coating thickness is found to be in the range from about 50 microns to about 150 microns before drying, although useful results can be obtained outside of this range. The resultant dry thickness of the coating is preferably between about 2 microns and about 50 microns, although useful results can be obtained with a dry coating thickness between about 1 and about 200 microns.

After the photoconductive elements prepared according to the present invention have been dried, they can be employed in any of the well-known electrophotographic processes which required photoconductive layers. One such process is the xerographic process. In a process of this type, an electrophotographic element is held in the dark and given a blanket electrostatic charge by placing it under a corona discharge. This uniform charge is retained by the layer because of the substantial dark insulating property of the layer i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically-responsive particles having optical density. The developing electrostatically-responsive particles can be in the form of a dust, i.e., powder, or a pigment in a resinous binder, i.e., toner. A preferred method of applying such toner to a latent electrostatic image for solid area development is by the use of a magnetic brush. Methods of forming and using a magnetic brush, toner applicator are described in the following U.S. patents: U.S. Pat. No. 2,786,439 by Young, issued Mar. 26, 1957; U.S. Pat. No. 2,786,440 by Giaimo, issued Mar. 26, 1957; U.S. Pat. No. 2,786,441 by Young, issued Mar. 26, 1957; U.S. Pat. No. 2,874,063 by Greig, issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, Metcalfe et al U.S. Pat. No. 2,907,674 issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review", Vol. 15 (1954), pages 469–484.

The electrical resistivity of the photoconductive insulating element of the invention (as measured across the photoconductive insulating composition of the element in the absence of activating radiation for the composition) should be at least about $10^9$ ohm-cms at 25° C. In general, it is advantageous to use elements having a resistivity several order of magnitude higher than $10^{10}$ ohm-cms, for example, elements having an electrical resistivity greater than about $10^{14}$ ohm-cms at 25° C.

As indicated earlier in the present application, the photoconductive insulating compositions of the present invention may be used, for example, in a conventional photoconductive element having a support, preferably a conducting support or a support bearing a layer of a conducting material, the support being overcoated with a single layer of a photoconductive composition comprising the material of the present invention. In such a case, the photoconductive material employed in this single active layer of photoconductive element would have a composition substantially as described earlier herein, i.e., a mixture of one or more of the aforementioned electron donors, one or more of the aforementioned electron acceptors, and one or more of the aforementioned p-type organic photoconductors. However, as also noted earlier herein, the photoconductive insulating compositions of the present invention also have been found useful when employed in photoconductive elements which are sometimes referred to in the art as "multi-active-layer" or "multi-active" elements, i.e., those photoconductive elements having more than one active layer incorporated therein. Typically, such multi-active elements have at least two active layers contained therein, for example, a light-sensitive layer capable of generating charge carriers, i.e., photoelectrons or positive hole carriers, and one or more charge-transport layers containing a material or materials capable of accepting and transporting the charge carriers injected therein from the charge-generating layer of the element.

With regard to the latter type of multi-active photoconductive elements, it has been found in accord with a further embodiment of the present invention that the photoconductive insulating compositions described herein may advantageously be employed in such multi-active photoconductive elements as the charge-generating layer thereof. In such case, one employs a photoconductive insulating composition as described earlier herein as a charge-generating layer of a multi-active photoconductive element in association with one or more charge-transport layers. The photoconductive insulating compositions of the present invention generate electrical charge carriers and inject them into the charge-transport layers of the resultant multi-active element.

Multi-active photoconductive elements incorporating the photoconductive compositions of the present invention as a charge-generating layer thereof may have various structural configurations. For example, such an element typically has a conducting support or a support bearing a conducting layer and coated thereover, in any order, are the charge-generating layer composed of the photoconductive composition of the present invention and one or more charge-transport layers. As indicated, in accord with this embodiment of the present invention, one can locate either the charge-generating layer of the charge-transport layer immediately adjacent the conducting support. In the case where the charge-generating layer is located immediately adjacent the conducting support of the multi-active photoconductive element and this charge-generating layer is, in turn, overcoated with one or more charge-transport layers; the charge-generating layer of the resultant element may be exposed to light radiation either by exposure thereof through the charge-transport layer or by exposure through the conducting support on which it is carried. In such a configuration, it will be appreciated that at least one of the charge-transport layers or the conducting support must be sufficiently transparent to permit transmission of light radiation within the photosensitive response region of the charge-generating layer such that photoelectrons or positive hole carriers can be generated by this layer.

Alternatively, in accord with a further variation of this embodiment of the invention, one can prepare a multi-active photoconductive element (using the photoconductive insulating compositions of the present invention as a charge-generating layer thereof) in which the arrangement of the charge-generating and charge-transport layers of the resultant element are such that the charge-transport layer or layers is located immediately adjacent the conducting support and the charge-generating layer is coated thereover. In such case, the charge-generating layer of the resultant multi-active element may be directly exposed to activating radiation without first having to pass through the charge-transport layer(s) or the conducting layer of the element.

Because the photoconductive insulating compositions of the present invention are ambipolar, i.e., capable of exhibiting useful photoconductive properties whether charged negatively or positively, the photoconductive insulating compositions of the invention (when employed as a charge-generating layer of a multi-active element) may be used in association with either p-type charge-transport layers, i.e., charge-transport layers primarily capable of positive hole transport, or with n-type charge-transport layers, i.e., charge-transport layers primarily capable of electron transport. And, of course, because the photoconductive insulating composition of the present invention is ambipolar, it may also be used as a charge-generating layer in combination with an ambipolar charge-transport layer, i.e., a layer capable of both hole and electron transport.

When the photoconductive insulating compositions of the present invention are used as a charge-generating layer of a multi-active photoconductive element, the composition of the charge-generating layer is the same as or similar to that described hereinabove wherein the compositions of the present invention are used to form a single active layer photoconductive element. The charge-transport layer or layers of these multi-active elements have a composition which, as is familiar to those skilled in the art, can be selected from any of a variety of well-known charge-transport materials. Typically, it has been found that charge-transport materials which provide optimum results are materials which, in their own right, are known to exhibit photoconductive properties. However, since these materials are used in the multi-active elements of the present invention primarily as charge-transport materials, and not as charge-generating materials, one actually uses only the charge-transport properties of these photoconductive materials, not the photosensitivity, i.e., charge-generating properties of the photoconductive materials. Thus, the charge-transport materials which can be used in the multi-active elements of the present invention may be selected from any of a variety of organic, including organo-metallic, and inorganic photoconductors which are capable of accepting charge carriers from the photoconductive compositions of the present invention and transporting these charge carriers. Especially good results have been found in accord with the present invention wherein the particular charge-transport material selected is an organic, including organo-metallic, photoconductive material.

As indicated, both p-type and n-type charge-transport materials may be used in combination with the charge-generating layer composed of the photoconductive insulating composition of the present invention to form a multi-active element. A variety of such p-type charge-transport materials are well-known and any of these may be used in the present invention so long as these materials have a capability of conducting positive charge carriers injected therein from the photoconductive insulating composition of the present invention. A partial listing of representative p-type photoconductive materials encompasses:

1. carbazole materials including carbazole, N-ethyl carbazole, N-isopropyl carbazole, N-phenylcarbazole, halogenated carbazoles, various polymeric carbazole materials such as poly(vinyl carbazole) halogenated poly(vinyl carbazole), and the like.
2. arylamine-containing materials including monoarylamines, diarylamines, triarylamines, as well as polymeric arylamines. A partial listing of specific arylamine organic photoconductors include the particular non-polymeric triphenylamines illustrated in Klupfel et al U.S. Pat. No. 3,180,730 issued Apr. 27, 1965; the polymeric triarylamines described in Fox U.S. Pat. No. 3,240,597 issued Mar. 15, 1966; the triarylamines having at least one of the aryl radicals substituted by either a vinyl radical or a vinylene radical having at least one active hydrogen-containing group as described in Brantly et al U.S. Pat. No. 3,567,450 issued Mar. 2, 1971; the triarylamines in which at least one of the aryl radicals is substituted by an active hydrogen-containing group as described in Brantly et al U.S. Pat. No. 3,658,520 issued Apr. 25, 1972; and tritolylamine.
3. polyarylalkane materials of the type described in Noe et al U.S. Pat. No. 3,274,000 issued Sept. 20, 1966; Wilson U.S. Pat. No. 3,542,547 issued Nov. 24, 1970; Seus et al U.S. Pat. No. 3,542,544 issued Nov. 24, 1970; and in Rule et al U.S. Pat. No. 3,615,402 issued Oct. 26, 1971. Preferred polyarylalkane photoconductors can be represented by the formula:

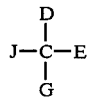

wherein D and G, which may be the same or different, represent aryl groups and J and E, which may be the same or different, represent a hydrogen atom, an alkyl group, or an aryl group, at least one of D, E and G containing an amino substituent. An especially useful polyarylalkane photoconductor which may be employed as the charge transport material is a polyarylalkane having the formula noted above wherein J and E represent a hydrogen atom, an aryl group, or an alkyl group and D and G represent substituted aryl groups having as a substituent thereof a group represented by the formula:

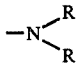

wherein R represents an unsubstituted aryl group such as phenyl or an alkyl substituted aryl such as a tolyl group. Additional information concerning certain of these latter polyarylalkane materials may be found in *Research Disclosure,* Vol. 133, May 1975, pages 7–11, entitled "Photoconductive Composition and Elements Containing Same".

4. strong Lewis base materials such as various aromatic including aromatically unsaturated heterocyclic-containing materials which are free of strong electron withdrawing groups. A partial listing of such aromatic Lewis base materials includes tetraphenylpyrene, 1-methyl-pyrene, perylene, chrysene, anthracene, tetraphene, 2-phenyl naphthalene, azapyrene, fluorene, fluorenone, 1-ethylpyrene, acetyl pyrene, 2,3-benzochrysene, 3,4-benzopyrene, 1,4-brompyrene, and phenyl-indole, polyvinyl pyrene, polyvinyl tetracene, polyvinyl perylene, and polyvinyl tetraphene.
5. other useful p-type charge-transport materials which may be employed in the present invention are any of the p-type organic photoconductors, including metallo-organo materials, and p-type inorganic photoconductors known to be useful in electrophotographic processes, such as any of the photoconductive materials described in *Research Disclosure,* Vol. 109, May 1973, pages 61–67, paragraph IV(A)(1) through (13) which are p-type photoconductors.

Representative of typical n-type charge-transport materials which are believed to be useful are strong Lewis acids such as organic, including metallo-organic, materials containing one or more aromatic, including aromatically unsaturated heterocyclic, materials, bearing an electron withdrawing substituent. These materials are considered useful because of their characteristic electron accepting capability. Typical electron withdrawing substituents include cyano and nitro groups; sulfonate groups, halogens such as chlorine, bromine and iodine; ketone groups; ester groups; acid anhydride groups; and other acid groups such as carboxyl and phenolic groups. A partial listing of such representative n-type aromatic Lewis acid materials having electron withdrawing substituents include phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4'-dinitrobiphenyl, 2,4,6-trinitroanisole, trichlorotrinitrobenzene, trinitro-0-toluene, 4,6-dichloro-1,3-dinitrobenzene, 4,6-dibromo-1,3-dinitrobenzene, p-dinitrobenzene, chloranil, bromanil, 2,4,7-trinitro-9-fluorenone, 2,4,5,7-tetranitrofluorenone, trinitroanthracene, dinitroacridene, tetracyanopyrene, dinitroanthraquinone, and mixtures thereof.

As suggested above, other useful n-type charge-transport materials which may be employed in the present invention are conventional n-type organic photoconductors, for example, selenium and complexes of 2,4,6-trinitro-9-fluorenone and poly(vinyl carbazole). Still other n-type photoconductive materials useful as n-type charge-transport materials in the present invention are any photoconductive materials known to be useful in electrophotographic processes such as any of the materials described in *Research Disclosure,* Vol. 109, May 1973, pages 61–67, paragraphs IV(A)(1) through (13) which are n-type photoconductors. The foregoing *Research Disclosure* article is incorporated herein by reference thereto.

As noted earlier herein, in accord with an especially preferred embodiment of the present invention, the photoconductive materials useful herein as charge-transport materials are advantageously those materials which exhibit little or no photosensitivity to radiation within the wavelength range to which the charge-generation layer is sensitive, i.e., radiation which causes the charge-generation layer to produce electron-hole pairs.

The charge-transport layer may consist entirely of the charge-transport materials described hereinabove, or, as is more usually the case, the charge-transport layer may contain a mixture of the charge-transport material in a suitable film-forming polymeric binder material. The binder material may, it if is an electrically insulating material, help to provide the charge-transport layer with electrical insulating characteristics, and it also serves as a film-forming material useful in (a) coating the charge-transport layer, (b) adhering the charge-transport layer to an adjacent substrate, and (c) providing a smooth, easy to clean, and wear-resistant surface. Of course, in instances where the charge-transport material may be conveniently applied without a separate binder, for example, where the charge-transport material is itself a polymeric material, such as a polymeric arylamine or poly(vinyl carbazole), there may be no need to use a separate polymeric binder. Similarly, if the charge-transport material can be applied by vacuum deposition techniques, binders are not required. However, even in many of the cases where binders are not required, the use of a polymeric binder may enhance desirable physical properties such as adhesion, resistance to cracking, etc.

Where a polymeric binder material is employed in the charge-transport layer, the optimum ratio of charge-transport material to binder material may vary widely depending on the particular polymeric binder(s) and particular charge-transport material(s) employed. In general, it has been found that, when a binder material is employed, useful results are obtained wherein the amount of active charge-transport material contained within the charge-transport layer varies within the range of from about 5 to about 90 weight percent based on the dry weight of the charge-transport layer.

A partial listing of representative materials which may be employed as binders in the charge-transport layer are film-forming polymeric materials having a fairly high dielectric strength and good electrically insulating properties. Such binders include styrene-butadiene copolymers; polyvinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrene; isobutylene polymers; polyesters, such as poly[ethylene-co-alkylenebis(alkyleneoxyaryl) phenylenedicarboxylate]; phenolformaldehyde resins; ketone resins; polyamides; polycarbonates, polythiocarbonates; poly[ethylene-co-isopropylidene-2,2-bis(ethyleneoxyphenylene)-terephthalate]; copolymers of vinyl haloarylates and vinyl acetate such as poly(vinyl-m-bromobenzoate-co-vinyl acetate); chlorinated poly(olefins), such as chlorinated poly(ethylene); etc. Methods of making resins of this type have been described in the prior art, for example, styrene-alkyd resins can be prepared according to the method described in Gerhart U.S. Pat. No. 2,361,019 issued Oct. 24, 1944 and Rust U.S. Pat. No. 2,258,423 issued Oct. 7, 1941. Suitable resins of the type contemplated for use in the charge-transport layers of the invention are sold under such tradenames as VITEL PE-101, CYMAC, Piccopale 100, Saran F-220, and LEXAN 145. Other types of binders which can be used in charge-transport layers include such materials as paraffin, mineral waxes, etc., as well as combinations of binder materials.

In general, it has been found that polymers containing aromatic or heterocyclic groups are most effective as the binder materials for use in the charge-transport layers because these polymers, by virtue of their heterocyclic or aromatic groups, tend to provide little or no interference with the transport of charge carriers through the layer. Heterocyclic or aromatic-containing polymers which are especially useful in p-type charge-transport layers include styrene-containing polymers, bisphenol-A-polycarbonate polymers, phenol-formaldehyde resins, polyesters such as poly[ethylene-co-isopropylidene-2,2-bis(ethyleneoxyphenylene)] terephthalate, and copolymers of vinyl haloarylates and vinylacetate such as poly(vinyl-m-bromobenzoate-co-vinyl acetate).

The charge-transport layer may also contain other addenda such as leveling agents, surfactants, plasticizers, and the like to enhance or improve various physical properties of the charge-transport layer. In addition, various addenda to modify the electrophotographic response of the element may be incorporated in the charge-transport layer. For example, various contrast control materials, such as certain hole-trapping agents and certain easily oxidized dyes may be incorporated in the charge-transport layer. Various such contrast control materials are described in *Research Disclosure,* Vol. 122, page 33, June 1974, in an article entitled "Additives for Contrast Control in Organic Photoconductor Compositions and Elements".

The thickness of the charge-transport layer may vary. It is especially advantageous to use a charge-transport layer which is thicker than that of the charge-generation layer, with best results generally being obtained when the charge-transport layer is from about 1 to about 200 times, and particularly 2 to 40 times, as thick as the charge-generation layer. A useful thickness for the charge-generation layer is within the range of from about 0.1 to about 15 microns dry thickness, particularly from about 2 to about 5 microns. However, useful results can also be obtained using a charge-transport layer which is thinner than the charge-generation layer.

The charge-transport layers described herein are typically applied to the desired substrate by coating a liquid dispersion or solution containing the charge-transport layer components. Typically, the liquid coating vehicle used is an organic vehicle. Typical organic coating vehicles include:

(1) aromatic hydrocarbons such as benzene, etc., including substituted aromatic hydrocarbons such as toluene, xylene, mesitylene, etc.;
(2) ketones such as acetone, 2-butanone, etc.;
(3) halogenated aliphatic hydrocarbons such as methylene chloride, chloroform, ethylene chloride, etc.;
(4) ethers, including cyclic ethers such as tetrahydrofuran, diethylether; and
(5) mixtures of the above.

When the photoconductive material of the present invention is used in a single layer photoconductive composition or as the charge generation layer of a multi-active photoconductive element, the total amount of the material of the present invention which is present in such compositions may vary widely. It is generally preferred to use at least about 15 weight percent (based on the total dry weight of a single layer photoconductive formulation or the total dry weight of the charge generation layer of a multi-active photoconductive formulation) of the material of the present invention, i.e., the above-described mixture of electron donor, electron acceptor and p-type organic photoconductor. This is particularly true where the material of the present invention is to be a primary photoconductive component of the resultant photoconductive composition. Of course, where the material of the present invention is used in combination with other photoconductive components of a particular composition to enhance the sensitivity of the resultant composition in certain areas of the visible spectrum, such as in the case of the various aggregate photoconductive compositions of the present invention (described in greater detail hereinafter), the total amount of the material of the present invention which is contained in the resultant composition may be substantially less than 15 weight percent.

Because the above-described multi-active photoconductive elements of the invention have been found to possess relatively high electrophotographic light sensitivity and because these elements, due to their light absorption characteristics in the blue and green region of the spectrum, can be designed to selectively exhibit sensitivity primarily in narrow bands located in the blue or green regions of the spectrum, it has been found that the above-described multi-active photoconductive elements of the invention are especially suited for use as the blue and green light sensitive components of a unitary color electrophotographic recording element as described in copending Kaukeinen and Turnblom U.S. patent application Ser. No. 847,464, filed Oct. 31, 1977, and entitled "Color Electrophotographic Process, Apparatus and Recording Element Useful Therein".

As noted hereinabove, the compositions of the present invention (including at least one p-type organic photoconductor together with at least one electron acceptor and at least one electron donor) may be incorporated as a separate photoconductive component into a multi-phase "aggregate" photoconductive composition. In such case, the compositions of the present invention are typically incorporated into the continuous, polymeric phase of the aggregate photoconductive composition.

As described in the aforementioned Light and Gramza et al patents, i.e., U.S. Pat. Nos. 3,615,414 and 3,732,180, respectively, multi-phase aggregate photoconductive compositions comprise a continuous polymeric phase containing dispersed therein a particulate co-crystalline complex of (1) an organic sensitizing dye such as a dye salt selected from the group consisting of pyrylium, thiapyrylium and selenapyrylium dye salts and (2) a polymer. Typically, the polymer has an alkylidene diarylene group in a recurring unit thereof or is a polymer having an equivalent group as a recurring unit which is capable of forming a co-crystalline complex with the above-described dye salts. Such polymers and many of their known equivalents capable of forming the co-crystalline complexes characteristic of aggregate photoconductive compositions are set forth in detail in the aforementioned Light patent U.S. Pat. No. 3,615,414 hereby incorporated by reference.

In general, the photoconductive compositions of the present invention are dissolved in the continuous polymeric phase of the above-described aggregate compositions. Of course, if the particular composition of the present invention is not soluble in the continuous polymeric phase of a specific aggregate formulation, it could be dispersed in the continuous phase to form a separately identifiable particulate phase of the aggregate composition.

As noted above the aggregate compositions used in this invention contain a co-crystalline complex of an organic sensitizing dye and a polymeric material such as an electrically insulating, film-forming polymeric material. They may be prepared by several techniques, such as, for example, the so-called "dye first" technique described in Gramza et al U.S. Pat. No. 3,615,396 issued Oct. 26, 1971. Alternatively, they may be prepared by the so-called "shearing" method described in Gramza U.S. Pat. No. 3,615,414 issued Oct. 26, 1971. This latter method involves the high speed shearing of the composition prior to coating and thus eliminates subsequent solvent treatment, as was disclosed in Light U.S. Pat. No. 3,615,414 referred to above. By whatever method prepared, the aggregate composition is combined with the photoconductive compositions of the invention in a suitable solvent and is coated on a suitable support to form a separately identifiable multi-phase composition, the heterogeneous nature of which is generally apparent when viewed under magnification, although such compositions may appear to be substantially optically clear to the naked eye in the absence of magnification. There can, of course, be macroscopic heterogeneity. Suitably, the dye-containing co-crystalline aggregate in the discontinuous phase is finely-divided, i.e., typically predominantly in the size range of from about 0.01 to about 25 microns.

In general, the aggregate compositions formed as described herein are multi-phase organic solids containing dye and polymer. The polymer forms an amorphous matrix or continuous phase which contains a discrete, discontinuous phase as distinguished from a solution. The discontinuous phase is the aggregate species which is a co-crystalline complex or co-crystalline compound composed of dye and polymer.

The term co-crystalline complex or co-crystalline compound as used herein has reference to a crystalline compound which contains dye and polymer molecules co-crystallized in a single crystalline structure to form a regular array of the molecules in a three-dimensional pattern.

Another feature characteristic of the aggregate compositions formed as described herein is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregates formed by this method is not necessarily an overall maximum for this system as this will depend upon the relative amount of dye in the aggregate. Such an absorption maximum shift in the formation of aggregate systems for the present invention is generally of the magnitude of at least about 10 nm. If mixtures of dyes are used, one dye may cause an absorption maximum shift to a long wavelength and another dye cause an absorption maximum shift to a shorter wavelength. In such cases, a formation of the aggregate compositions can more easily be identified by viewing under magnification.

Typical organic sensitizing dyes used in forming these aggregate compositions are pyrylium-type dye salts, including pyrylium, bispyrylium, thiapyrylium and selenapyrylium dye salts and also including salts of pyrylium compounds containing condensed ring systems such as salts of benzopyrylium and naphthopyrylium dyes. Preferred dyes from these classes which may be used are disclosed in Light U.S. Pat. No. 3,615,414 and VanAllan et al U.S. Pat. No. 3,250,615.

Particularly useful dyes in forming the feature aggregates are pyrylium dye salts having the formula:

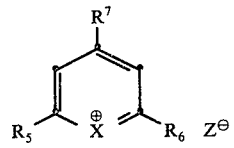

wherein $R_5$ and $R_6$ can each be a phenyl group, including substituted phenyl group having at least one substituent chosen from alkyl groups of from 1 to about 6 carbon atoms and alkoxy group having from 1 to about 6 carbon atoms;

$R_7$ can be an alkylamino-substituted phenyl group having from 1 to 6 carbon atoms in the alkyl group, and including dialkylamino-substituted and haloalkylamino-substituted phenyl groups;

X can be an oxygen, selenium, or a sulfur atom; and $X^{\theta}$ is an anion.

The polymers useful in forming the aggregate compositions as noted above may be selected from a variety of materials. Particularly useful are hydrophobic, film-forming polymers having an alkylidene diarylene group in a recurring unit such as those linear polymers, including copolymers, containing the following group in a recurring unit:

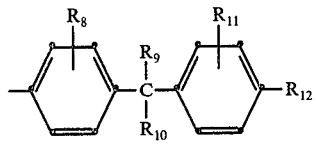

wherein $R_9$ and $R_{10}$, when taken separately, can each be a hydrogen atom, an alkyl group having from one to about 10 carbon atoms such as methyl, ethyl, isobutyl, hexyl, heptyl, octyl, nonyl, decyl, and the like, including substituted alkyl groups such as trifluoromethyl, etc., and an aryl group such as phenyl and naphthyl, including substituted aryl groups having such substituents as a halogen atom, an alkyl group of from 1 to about 5 carbon atoms, etc.; and $R_9$ and $R_{10}$, when taken together, can represent the carbon atoms necessary to complete a saturated cyclic hydrocarbon group including cycloalkanes such as cyclohexyl and polycycloalkanes such as norbornyl, the total number of carbon atoms in $R_9$ and $R_{10}$ being up to about 19;

$R_8$ and $R_{11}$ can each by hydrogen, an alkyl group of from 1 to about 5 carbon atoms, e.g., or a halogen such as chloro, bromo, iodo, etc.; and $R_{12}$ is a divalent group selected from the following:

$$-O-\overset{O}{\overset{\|}{C}}-O,\ -O-\overset{S}{\overset{\|}{C}}-O,\ -\overset{O}{\overset{\|}{C}}-O-,\ -\overset{O}{\overset{\|}{C}}-O-CH_2-,$$

$$-\overset{O}{\overset{\|}{C}}-O-\overset{CH_3}{\overset{|}{CH}}-,\ -CH_2-O-\overset{O}{\overset{\|}{C}}-O \text{ and}$$

-continued

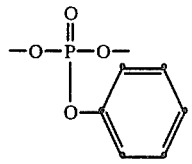

Preferred polymers useful for forming aggregate crystals are hydrophobic carbonate polymers containing the following group in a recurring unit:

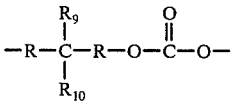

wherein each R is a phenylene group including halo substituted phenylene groups and alkyl-substituted phenylene groups; and $R_9$ and $R_{10}$ are as described above. Such compositions are disclosed, for example, in U.S. Pat. Nos. 3,028,365 and 3,317,466. Preferably polycarbonates containing an alkylidene diarylene group in the recurring unit such as those prepared with Bisphenol A and including polymeric products of ester exchange between diphenylcarbonate and 2,2-bis(4-hydroxyphenyl)propane are useful in the practice of this invention. Such compositions are disclosed in the following U.S. patents: U.S. Pat. No. 2,999,750 by Miller et al, issued Sept. 12, 1961; U.S. Pat. No. 3,038,879 by Laakso et al, issued June 12, 1962; U.S. Pat. No. 3,038,880 by Laakso et al, issued June 12, 1962; U.S. Pat. No. 3,106,544 by Laakso et al, issued Oct. 8, 1963; U.S. Pat. No. 3,106,545 by Laakso et al, issued Oct. 8, 1963; and U.S. Pat. No. 3,106,546 by Laakso et al, issued Oct. 8, 1963. A wide range of film-forming polycarbonate resins are useful, with completely satisfactory results being obtained when using commercial polymeric materials which are characterized by an inherent viscosity of about 0.5 to about 1.8.

The following representative polymers are included among the materials useful in the preparation of aggregate materials:

Table 2

| No. | Polymeric Material |
|---|---|
| 1 | poly(4,4'-isopropylidenediphenylene-co-1,4-cyclohexylenedimethylene carbonate) |
| 2 | poly(ethylenedioxy-3,3'-phenylene thiocarbonate) |
| 3 | poly(4,4'-isopropylidenediphenylene carbonate-co-terephthalate) |
| 4 | poly(4,4'-isopropylidenediphenylene carbonate) |
| 5 | poly(4,4'-isopropylidenediphenylene thiocarbonate) |
| 6 | poly(4,4'-sec-butylidenediphenylene carbonate) |
| 7 | poly(4,4'-isopropylidenediphenylene carbonate-block-oxyethylene) |
| 8 | poly(4,4'-isopropylidenediphenylene carbonate-block-oxytetramethylene) |
| 9 | poly[4,4'-isopropylidenebis(2-methylphenylene)-carbonate] |
| 10 | poly(4,4'-isopropylidenediphenylene-co-1,4-phenylene carbonate) |
| 11 | poly(4,4'-isopropylidenediphenylene-co-1,3-phenylene carbonate) |
| 12 | poly(4,4'-isopropylidenediphenylene-co-4,4'-diphenylene carbonate) |
| 13 | poly(4,4'-isopropylidenediphenylene-co-4,4'-oxydiphenylene carbonate) |
| 14 | poly(4,4'-isopropylidenediphenylene-co-4,4'-carbonyldiphenylene carbonate) |
| 15 | poly(4,4'-isopropylidenediphenylene-co-4,4'-ethylenediphenylene carbonate) |
| 16 | poly[4,4'-methylenebis(2-methylphenylene)carbonate] |
| 17 | poly[1,1-(p-bromophenylethylidene)bis-(1,4-phenylene)carbonate] |
| 18 | poly[4,4'-isopropylidenediphenylene-co-4,4'-sulfonyldiphenylene)carbonate] |
| 19 | poly[4,4'-cyclohexylidene(4-diphenylene) carbonate] |
| 20 | poly[4,4'-isopropylidenebis(2-chlorophenylene)carbonate] |
| 21 | poly(4,4'-hexafluoroisopropylidenediphenylene carbonate) |
| 22 | poly(4,4'-isopropylidenediphenylene 4,4'-isopropylidenedibenzoate) |
| 23 | poly(4,4'-isopropylidenedibenzyl 4,4'-isopropylidenedibenzoate) |
| 24 | poly[4,4'-(1,2-dimethylpropylidene)-diphenylene carbonate) |
| 25 | poly[4,4'-(1,2,2-trimethylpropylidene)-diphenylene carbonate] |
| 26 | poly{4,4'-[1-(α-naphthyl)ethylidene]-diphenylene carbonate} |
| 27 | poly[4,4'-(1,3-dimethylbutylidene)-diphenylene carbonate] |
| 28 | poly[4,4'-(2-norbornylidene)diphenylene carbonate] |
| 29 | poly[4,4'-(hexahydro-4,7-methanoindan-5-ylidene) diphenylene carbonate] |

The amount of the above-described, pyrylium-type dye salt used in the various aggregate-containing compositions described herein may vary. Useful results are obtained by employing the described pyrylium-type dye salts in amounts of from about 0.001 to about 50 percent based on the dry weight of the aggregate composition. The amount used varies widely depending on such factors as dye solubility, the polymer contained in the continuous phase, additional photoconductive materials, the electrophotographic response desired, the mechanical properties desired, etc. Similarly, the amount of alkylidene diarylene group-containing polymer used in the aggregate composition referred to herein may vary. Typically, these aggregate compositions contain an amount of this polymer within the range of from about 20 to about 98 weight percent based on the dry weight of the aggregate composition, although larger or smaller amounts may also be used.

Electrophotographic elements of the invention containing the above-described aggregate composition can be prepared by blending a dispersion or solution of the composition and coating or forming a self-supporting layer with the materials.

If desired, other polymers can be incorporated in the multi-phase aggregate compositions described herein, for example, to alter physical properties such as adhesion of the aggregate-containing layer to the support and the like. This can be achieved by employing "preformed" or "isolated" aggregate materials composed solely of the above-described co-crystalline complex and dispersing these aggregate materials, in particulate form, in layers containing such additional vehicles. Techniques for preparing such pre-formed aggregate materials are described in Stephens U.S. Pat. No. 3,679,407 issued July 25, 1972 and in Gramza et al U.S. Pat. No. 3,732,180. In fact, the photoconductive compositions of the invention have been found especially useful when incorporated in aggregate photoconductive elements composed of the "isolated" of "preformed" aggregate materials. When incorporated in such aggregate compositions, one obtains significantly improved transport of charge carriers as well as enhanced pan-sensitivity.

The aggregate photoconductive layers of the invention can also be sensitized by the addition of effective amounts of sensitizing compounds to exhibit improved electrophotosensitivity. Of course, the multi-phase, aggregate compositions may also contain other addenda such as leveling agents, surfactants, plasticizers, contrast control material and the like to enhance or improve various physical properties or electrophotographic response characteristics of the aggregate photoconductive layer.

In accord with that embodiment of the invention wherein the photoconductive materials of the invention are incorporated as a separate photoconductive component into an aggregate photoconductive composition, the amounts thereof which can be used may be varied over a relatively wide range. When used in an aggregate photoconductive composition, the photoconductive compositions of the invention are contained in the continuous phase of the aggregate composition and may be present in an amount within the range of from about 1.0 to about 60.0 percent by weight (based on the dry weight of the aggregate photoconductive composition). Larger or smaller amounts of the photoconductive materials of the invention may also be employed in aggregate photoconductive compositions although best results are generally obtained when using an amount within the aforementioned range.

As indicated earlier herein, when the photoconductive compositions of the present invention are incorporated in the above-described aggregate photoconductive compositions, the resultant aggregate composition can be used as a conventional single-layer photoconductive material as set forth in Light U.S. Pat. No. 3,615,414 and Gramza et al U.S. Pat. No. 3,732,180 or it can be used as the charge-generating layer in a multi-active photoconductive element as described in the above-referenced Berwick et al application, U.S. Ser. No. 639,039 filed Dec. 9, 1975. In the latter case, the aggregate charge-generating layer is used in combination with one or more n-type or p-type charge-transport layers. The requisite properties of such charge-transport layers are essentially identical to the charge-transport layers described earlier herein so that extended description of these materials is unnecessary at this point. If further detail is desired concerning charge-transport layers particularly suited for aggregate charge-generation layers, reference may be made to the above-noted Berwick et al application or *Research Disclosure,* Vol. 133, dated May 1975, pages 38–43, in an article entitled "Multi-Active Photoconductive Element".

The following examples are included for a further understanding of the invention.

In Examples 1A-1D, 2, 3, 4, 5A and 5B hereinafter, a series of photoconductive insulating formulations were prepared and the relative light sensitivity exhibited by each of these formulations are compared as summarized in Table 3. Several of the photoconductive formulations reported in Table 3 represent control formulations outside the scope of the present invention and are presented to illustrate certain of the advantages provided by the present invention. In this regard, Example 1B represents a control photoconductive formulation representing one of the preferred photoconductive compositions described in Contois et al U.S. Pat. No. 3,655,378 and contains a charge-transfer complex of TNF and a resin formed by the condensation of dibenzothiophene and formaldehyde. Example 1C represents another control formulation somewhat similar to a further embodiment of the photoconductive compositions described in U.S. Pat. No. 3,655,378 wherein a small amount of tris-p-tolylamine was added as a chemical sensitizer. However, in Example 1C a relatively large amount of tris-p-tolylamine was added (rather than the small amounts described in U.S. Pat. No. 3,655,378). This was done to demonstrate that even by adding larger amounts of tris-p-tolylamine (approximately equal to the amount of p-type organic photoconductor called for in the formulations of the present invention), one cannot obtain photoconductive formulations (using the resinous donor materials described in U.S. Pat. No. 3,655,378) which exhibit the substantially improved sensitivity possessed by the most closely related formulations of the present invention. Examples 1D and 5B represent further control formulations showing the substantially lower sensitivity which is exhibited by formulations outside the scope of the present invention wherein the p-type organic photoconductor component has been deleted. Examples 1A, 2, 3, 4 and 5A represent various photoconductive formulations of the present invention. The formulations M(1) and M(2) of Examples 3 and 5A represent photoconductive insulating compositions illustrative of multi-active elements which employ photoconductive formulations of the present invention. In Examples 1A-1D, 2, 3, 4, 5A and 5B, as well as in other examples, the following abbreviations are used:

Dibenzothiophene = DBT
Dibenzothiophene-formaldehyde resin = DBTF
Tetrahydrofuran solvent = THF
Tris(p-tolyl)amine = TTA
Dichloromethane solvent = DCM
2,4,7-Trinitro-9-fluorenone = TNF
2,4,5,7-Tetranitro-9-fluorenone = $T_4NF$

EXAMPLE 1A

Dibenzothiophene-TNF-tris-(p-tolyl)amine Formulation of the Invention

Lexan® 145, a trademark of General Electric Co. for high viscosity bisphenol A polycarbonate, (4.40 g) was added slowly, with rapid stirring, to a solution of 0.835 g (4.54 mmol) of dibenzothiophene (DBT) in 66.6 g of tetrahydrofuran (THF). When solution obtained, 4.45 g (15.5 mmol) of tris(p-tolyl)amine (TTA) was added. To this solution was added 0.5 g of a 10 percent by weight solution of surfactant in THF. A solution of 1.43 g (4.54 mmol) of TNF in 15 g of THF was added, with rapid stirring, to the above solution. After brief but thorough stirring, the solution was coated using a 0.015 cm coating knife at 35° C onto a vacuum-deposited conductive layer coated on a polyester film support. After initial drying, the coating was dried at 90° C for 20 min.

EXAMPLE 1B

Dibenzothiopheneformaldehyde-TNF Control Formulation

Dibenzothiopheneformaldehyde resin (DBTF) (0.405 g) was dissolved in 2.00 g of dichloromethane (DCM) with rapid stirring. Vitel PE-101 polyester, a trademark of Goodyear Tire and Rubber Co., (0.405 g) was added to this solution and dissolved with rapid stirring. Finally, three drops of a 10% by weight solution of surfactant in DCM was added. To this solution was added a solution of 0.285 g TNF in 6.0 g DCM. After brief mixing, the solution was coated as described in Example 1A and dried overnight at 60° C.

EXAMPLE 1C

DBTF-TNF-TTA Control Formulation

Lexan® 145 (0.880 g) was dissolved in 3.50 g of DCM with rapid stirring; after solution obtained, 9.80 g of THF was added, followed by 0.11 g of surfactant solution (10% by weight in THF). DBTF (0.405 g) was added, followed by 0.890 g of TTA. To this solution was added a solution of 0.285 g TNF in 3.0 g THF. After brief mixing, the solution was coated as in Example 1A. It was dried for 15 min. at 90° C.

EXAMPLE 1D

DBT-TNF Control Formulation

Lexan® 145 (1.35 g) was dissolved in 13.5 g of THF and 0.17 g of surfactant solution (10% by weight in THF) with rapid stirring. DBT (0.332 g, 1.80 mmol) was added to this solution, followed by a solution of 0.568 g of TNF (1.80 mmol) in 12.35 g of THF. After brief mixing, the solution was coated as in Example 1A. It was dried at 90° C for 20 min.

EXAMPLE 2

DBT:TNF:TTA (1:1:1) Formulation of the Invention

The following procedure and formulation was used as a standard for evaluation of other photoconductive compositions of the invention. The amounts of new donors, acceptors, and p-type organic photoconductors were simply adjusted to maintain a total weight of 0.90 g and a molar ratio of 1:1:1.

Lexan® 145 (1.35 g) was dissolved in 12.50 g of THF containing 0.09 g of surfactant solution (10% by weight in THF) with rapid stirring. When solution was obtained, 0.211 g (1.14 mmol) of DBT and 0.328 g (1.14 mmol) of TTA were added. To this solution was added a solution of 0.362 g (1.14 mmol) of TNF in 4.00 g of THF. After brief mixing, the solution was coated with a 0.015 cm knife at 35° C under low draft conditions onto a vacuum-deposited conductive layer carried on a polyester film support. After initial drying, the coating was dried at 90° C for 20 min. or 70° C for 45 min.

EXAMPLE 3

The following procedure is representative of multi-active film preparation and was used for evaluation of other materials in this mode of the invention:

Multi-Active Film Formulation

The solution described in Example 2 was coated and dried as described therein but 0.0025 cm and 0.005 cm coating blades were used instead of a 0.015 cm blade. A solution of 8.4 g of Lexan 145 and 5.6 g of TTA in 86.0 g DCM and 0.6 g of surfactant solution (10% by weight) was prepared. When the above 0.0025 cm and 0.005 cm coatings were dry, the Lexan 145-TTA solution was coated over them with a 0.010 cm knife at 35° C. These coatings were again dried at 70° C for 45 min. As a result two multi-active elements of the invention, M(1) and M(2) were obtained.

EXAMPLE 4

Use of p-type organic photoconductors other than tris(p-tolyl)amine with the DBT-TNF Complex Using the procedure described in Example 2, bis(4-diethylamino-2-methylphenyl)phenylmethane (OP-A), bis(4-diethylaminophenyl)diphenylmethane (OP-B), and 4-(di-p-tolylamino)-4'-[4-(di-p-tolylamino)-β-styryl]stilbene (OP-C) were formulated with DBT:TNF.

EXAMPLE 5A

DBT:2,4,5,7-tetranitro-9-fluorenone ($T_4NF$): tris(p-tolyl)amine

Using the procedures described in Examples 2 and 3, one single layer and two multi-active coatings of the above composition were prepared.

EXAMPLE 5B

DBT:$T_4NF$ Control

Using the procedure described in Example 5, a single layer of the above complex was prepared. Vitel PE-101 replaced Lexan 145 in this formulation, and the TTA was omitted.

Table 3

| Example No. | Film Structure[a] | Donor | Acceptor | Photo-conductor | Molar Ratio | Relative Sensitivity (energy$^{-1}$) Positive Charging Blue | Positive Charging Green | Negative Charging Blue | Negative Charging Green |
|---|---|---|---|---|---|---|---|---|---|
| 1A | S | DBT | TNF | TTA | 1:1:3.4 | 7.4 | — | 6.2 | — |
| 1B | S | DBTF | TNF | — | (c) | 0.18 | 1.7 | — | — |
| 1C | S | DBTF | TNF | TTA | (c):1:3.4 | 0.25 | 3.2 | — | — |
| 1D | S | DBT | TNF | — | 1:1 | 1.0[b] | 1.0[b] | — | — |
| 2 | S | DBT | TNF | TTA | 1:1:1 | 6.5 | 15.9 | 4.3 | 28.9 |
| 3 | M(1) | DBT | TNF | TTA | 1:1:1 | — | — | 8.1 | 11.3 |
| 3 | M(2) | DBT | TNF | TTA | 1:1:1 | — | — | 10.2 | 22.3 |
| 4 | S | DBT | TNF | OP-A | 1:1:1 | 2.3 | 6.5 | 5.1 | 14.4 |
| 4 | S | DBT | TNF | OP-B | 1:1:1 | 1.3 | 4.4 | 4.2 | 8.3 |
| 4 | S | DBT | TNF | OP-C | 1:1:1 | 0.06 | 2.2 | 2.4 | 7.9 |
| 5A | S | DBT | $T_4NF$ | TTA | 1:1:1 | 1.6 | 23.5 | 2.7 | 42.5 |
| 5A | M(1) | DBT | $T_4NF$ | TTA | 1:1:1 | — | — | 0.81 | 6.1 |
| 5A | M(2) | DBT | $T_4NF$ | TTA | 1:1:1 | — | — | 1.8 | 22.0 |
| 5B | S | DBT | $T_4NF$ | — | 1:1 | 0.98 | 9.5 | 0.21 | 0.42 |

[a]S = Single layer, M = multiactive
[b]Arbitrarily assigned a value of unity; comparisons are valid only for a given color
[c]Molecular weight of DBTF is unknown Evaluation of the materials described above in Examples 1–5 was done using broad band color exposure and photodecay measurements. Sensitivities for each color photodecay reported in Table 3 are in relative units of reciprocal energy and represent photodischarge from 500 to 100 volts. While comparison of data for a given color exposure is valid, direct comparison of blue with green, for example, is not valid due to the nature of the total energy output of the color exposure sources. Single layer films were charged on the surface with both positive and negative corona chargers, while multiactive structures were charged with negative corona only; exposure was through the film support.

As can be seen from the results reported in Table 3, the photoconductive compositions of the present invention, i.e., Examples 1A, 2, 3, 4 and 5A, exhibit substantially greater light sensitivity than the various control formulations, i.e., Examples 1B, 1C, 1D and 5B.

EXAMPLE 6

To illustrate the importance of using a sufficient amount of the electron acceptor component in the photoconductive compositions of the invention, two compositions were prepared, PC #1 and PC #2, which were identical except that PC #1 (a control) contained a molar ratio of DBT:TNF:TTA of 1:0.1:1 whereas PC #2 (of the invention) contained a molar ratio of DBT:TNF:TTA of 1:1:1. PC #1 and PC #2 were prepared and coated onto a conductive layer of a polyester film support as described in Example 1A above. The light sensitivity of the PC #1 and PC #2 films was then evaluated by measuring the relative energy (in ergs/cm$^2$) required to discharge these films from 500 volts to 100 volts using three different line exposure sources, i.e., a 420 nm source, a 450 nm source and a 500 nm source. The films were evaluated using both positive and negative corona charging. The results of this test are reported below in Table 4.

Table 4

| PC Number | Surface Potential (positive or negative) | Relative Energy for 500 v to 100 v Discharge | | |
|---|---|---|---|---|
| | | 420 nm | 450 nm | 500 nm |
| #1 | + | 52 | 79 | 87 |
| #1 | − | 8.3 | 4.7 | 11 |
| #2 | + | 1.0* | 1.0* | 1.0* |
| #2 | − | 6.1 | 4.4 | 2.6 |

*Arbitrarily assigned a relative value of 1.0 erg/cm$^2$ for ease of comparison.

EXAMPLE 7

To illustrate the significant increase in light sensitivity exhibited by the photoconductive compositions of the present invention in comparison to prior art photoconductive compositions composed of polyvinyl carbazole (PVK) and TNF, the following tests were performed. First, a 1:1 equimolar solution of PVK and TNF was prepared and coated onto a conductive support in a manner similar to that described in Example 1A to form a control photoconductive element PC #3. Next, another control photoconductve element, i.e., PC #4, identical to PC #3 was prepared, except that TTA was added to the photoconductive composition of this element to evaluate the effectiveness of incorporating a p-type organic photoconductor in the PVK-TNF system. PC #4 was thus composed of a 1:1:1 equimolar composition of PVK:TNF:TTA. PC #3 and #4 did not contain any Lexan binder, the PVK component of these compositions being capable of acting as the binder at least for the limited purposes of this test. Therefore, PC #3 and #4 consisted entirely of active ingredients. The light sensitivity of PC #3 and #4 was then compared to the DBT:TNF:TTA formulation of the present invention described in Example 2 above. The formulation of Example 2 contains about 60% by weight Lexan 145 as binder and about 40% by weight of active ingredients consisting of an equimolar mixture of DBT, TNF and TTA. In this test, the visible light sensitivity of each of the test photoconductive compositions in both positive and negative corona charging modes was evaluated. As a result, it was found that the light sensitivity of PC #4 was about two times less than that of PC #3 for positive corona charging; however, for negative corona charging, PC #4 exhibited slightly greater light sensitivity than PC #3. Both PC #3 and PC #4 exhibited about seven to ten times less visible light sensitivity, in both negative and positive corona charging modes, than the photoconductive composition of the present invention, i.e., the composition of Example 2. The results of this test clearly indicate the superiority in light sensitivity of the present invention over prior art compositions consisting of PVK and TNF and modifications of these compositions containing TTA.

EXAMPLE 8

In Example 3 above, a multi-active film formulation is illustrated having a charge generation layer composed of the photoconductive composition of the invention and a charge-transport layer containing TTA, a p-type charge-transport material. To illustrate that the photoconductive compositions of the invention can also be used in multi-active photoconductive elements in combination with n-type charge-transport materials, a multi-active element similar to that of FIG. 3 was prepared, except that TNF was used in the charge-transport layer instead of TTA and 2-nitrodibenzothiophene was used in place of DBT in the charge-generation layer. TNF is a well-known n-type charge-transport material. The light sensitivity of the multi-active element of this example was then evaluated and found to compare quite favorably with the good results exhibited by the multi-active element of Example 3.

EXAMPLE 9

In this example, a series of single layer photoconductive compositions of the present invention were prepared in a manner similar to that described hereinabove in Example 2, except that electron donor DBT was replaced with a series of other donors representative of those illustrated by structural formulas I–III set forth previously herein. In each case, substantial gains in light sensitivity were recorded for at least one mode of corona charging (i.e., negative or positive charging) in comparison to control compositions prepared with an identical electron donor and electron acceptor but without any p-type organic photoconductor, i.e., TTA. The structures of each of the different donors tested in this example are set forth in Table 5 below:

Table 5

1. Formula I Donors

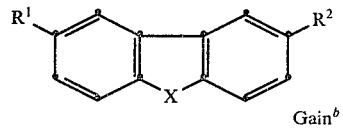

| Donor Tested | R$^1$ | R$^2$ | X | Gain$^b$ (positive charging) | Gain$^b$ (negative charging) |
|---|---|---|---|---|---|
| No. 1 | Hydrogen | Hydrogen | Sulfur | 133 | 12 |
| No. 2 | Hydrogen | Bromine | Sulfur | 4.1 | 54.4 |
| No. 3 | Bromine | Bromine | Sulfur | 0.93 | 21.3 |
| No. 4 | Nitro | Hydrogen | Sulfur | 6.4 | 136 |
| No. 5 | Hydrogen | Hydrogen | Oxygen | 7.6 | 26.3 |
| No. 6 | Hydrogen | Hydrogen | $-CH_2-$ | 21.8 | 13.8 |

2. Formula II Donors

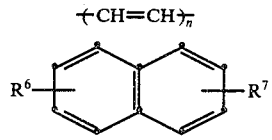

Table 5-continued

| Donor Tested | $R^6$ | $R^7$ | n | Gain[b] (positive charging) | Gain[b] (negative charging) |
|---|---|---|---|---|---|
| No. 7 | Hydrogen | Hydrogen | 1 | ∞ | ∞ |
| No. 8 | Hydrogen | Hydrogen | 0 | 14.6 | 100 |

3. Formula III Donors

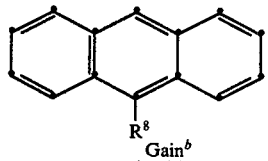

| Donor Tested | $R^8$ | Gain[b] (positive charging) | Gain[b] (negative charging) |
|---|---|---|---|
| No. 9 | $NO_2$ | 21.2 | 349 |

4. Other Formula I Donors

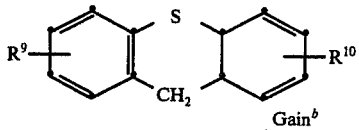

| Donor Tested | $R^9$ | $R^{10}$ | Gain[b] (positive charging) | Gain[b] (negative charging) |
|---|---|---|---|---|
| No. 10 | Hydrogen | Hydrogen | 18.5 | 28.3 |

[b]Gain represents the factor by which a control composition without TTA is slower (i.e., less light sensitive) than the composition of the present invention which contains TTA. A value less than unity implies the control composition without TTA is faster (i.e., exhibits greater light sensitivity). A value of ∞ indicates that the control exhibited no measurable light sensitivity. Light sensitivity was measured by determining the energy in ergs/cm$^2$ of 450 nm light or of broadband blue light required to discharge the composition being tested from ±500 volts to ±100 volts.

EXAMPLE 10

In this example a series of additional single layer photoconductive compositions of the present invention were prepared in a manner similar to that described hereinabove in Example 2, except that the electron acceptor DBT was replaced with a series of other donors (see Table 6 below) representative of those illustrated by structural formulas I–III set forth in Example 9. In each case the resultant compositions exhibited a useful level of photoconductivity.

Table 6

Other Formula I Donors

| Donor Tested | $R^1$ | $R^2$ | X |
|---|---|---|---|
| No. 11 | Hydrogen | Hydrogen | $>C=CH-C_6H_4-NO_2$ |
| No. 12 | Bromine | Bromine | $>C=CH-C_6H_4-NO_2$ |
| No. 13 | 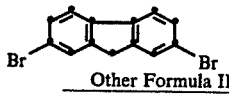 | | |

Other Formula III Donors

| Donor Tested | $R^8$ |
|---|---|
| No. 14 | CN |
| No. 15 | $NO_2$ |
| No. 16 | $CH_3$ |
| No. 17 | $C(CH_3)_3$ |

EXAMPLE 11

In this example a series of additional single layer photoconductive compositions of the invention were prepared in a manner similar to that described hereinabove in Example 2, except that various electron acceptors (see Table 7 below) other than TNF or various electron donors (see Table 7 below) other than DBT were employed. In each of these cases, the resultant compositions exhibited useful levels of photoconductivity.

Table 7

| Composition | Electron Donor | Electron Acceptor | p-type Photoconductor |
|---|---|---|---|
| A | No. 1 of Ex. 9 | 2,4,5,7-tetranitro-9-fluorenone ($T_4NF$) | TTA |
| B | No. 10 of Ex. 9 | $T_4NF$ | TTA |
| C | No. 9 of Ex. 9 | $T_4NF$ | TTA |
| D | No. 8 of Ex. 9 | $T_4NF$ | TTA |
| E | No. 7 of Ex. 9 | $T_4NF$ | TTA |
| F | No. 3 of Ex. 9 | $T_4NF$ | TTA |
| G | No. 1 of Ex. 9 | hexyl-2,7-dinitro-9-dicyanomethylenefluorene-4-carboxylate (HDDF) | TTA |
| H | No. 9 of Ex. 9 | HDDF | TTA |
| I | No. 3 of Ex. 9 | HDDF | TTA |
| J | No. 14 of Ex. 10 | HDDF | TTA |
| K | No. 1 of Ex. 9 | tetracyanopyrazine | TTA |
| L | No. 1 of Ex. 9 | 1,3,7-trinitrodibenzothiophene sulfone | TTA |
| M | No. 1 of Ex. 9 | 3,7-di-nitrodibenzothiophene sulfone | TTA |
| N | No. 1 of Ex. 9 | 3,3',5-trinitrobenzophenone | TTA |
| O | No. 1 of Ex. 9 | 2,6,8-trinitro-4H-inden-(1,2-b)thiophen-4-one | TTA |

EXAMPLE 12

Multi-active aggregate photoconductive composition containing the present invention Samples of "isolated" or "pre-formed" crystalline aggregate particles composed of 20% by weight of 4-(4-dimethyl-aminophenyl)-2,6-diphenyl thiapyrylium fluoroborate in Lexan 145® polycarbonate were prepared in a manner similar to that described in Example 9 of U.S. Pat. No. 3,732,180. The resultant aggregate crystals were then milled with 0.31 cm zirconium oxide beads in toluene on a high frequency vibrating mixer for 2.5 hours.

To a separate solution containing 24.0 g of Geon 222 (copolymer of vinyl chloride/vinylidene chloride purchased from B. F. Goodrich Co.) in 105 ml of toluene containing a surfactant was added 23.1 g of 9-anthronitrile:TNF complex and 12.9 g of TTA. This mixture was milled in a polypropylene container on a high frequency vibrating mixer with 0.31 cm diameter zirconium oxide beads for 2.5 hours. The resultant "charge-transfer" dispersions were combined, diluted with 290 ml of toluene and filtered through a Buchner funnel to remove the beads.

The appropriate weight of "charge-transfer" dispersion was added to the "isolated" aggregate dispersion and the mixture was milled for an additional 25 minutes, diluted with toluene to the desired coating concentration, and then coated to form a charge generation layer on a 0.4 optical density conductive nickel-coated polyester film support. The isolated aggregate-charge-transfer layer was subsequently overcoated with a charge transport layer composed of polystyrene and TTA (60:40 weight ratio) in toluene (15% solids). Total dry thickness of this multi-active element was about 15 microns; the dry thickness of the charge generation layer was about 2.5 to 5.0 microns.

The composition of samples of this multi-active element and related controls, therefore, were tabulated as follows.

| Sample | Isolated Aggregate(g) | Charge-Transfer(g) | Geon 222 Binder(g) |
|---|---|---|---|
| 1-A(Control) | 0.125 | 0 | 0.083 |
| 1-B(Element of the Invention) | 0.125 | 0.375 | 0.417 |
| 1-C(Control) | 0 | 1.36 | 0.900 |

Each of the above-identified controls and sample elements of the invention were then subjected to the following test:

SPECTRAL SENSITIVITY TEST

Relative sensitivity in relative units of reciprocal energy required to reduce an initial charge level, Vo, of 600 volts to 300 volts using negative charging and front exposure.

| Sample | Relative Sensitivity (energy$^{-1}$) 400 nm | 420 nm | 440 nm | 460 nm | 480 nm | 500 nm | 680 nm |
|---|---|---|---|---|---|---|---|
| 1-A(Control) | 0.19 | 0.13 | 0.037 | 0.022 | 0.03 | 0.05 | 1.0* |
| 1-B(Element of the Invention) | 0.58 | 0.78 | 0.68 | 0.59 | 0.73 | 0.72 | 0.67 |
| 1-C(Control) | 0.80 | 0.86 | 0.69 | 0.68 | 0.68 | 0.71 | 0 |

*Assigned an arbitrary value of 1 at 680nm for ease of comparison.

As can be seen from the foregoing table, the multi-active aggregate element containing the photoconductive composition of the invention exhibits substantially panchromatic response across the visible spectrum whereas the controls exhibit pronounced sensitivity maximas in certain regions and sensitivity minimas in other areas of the visible spectrum.

EXAMPLE 13

To illustrate the use of the Charge Transfer Formation Test described earlier herein, a series of organic solvent solutions were prepared using a variety of different electron donors, both with and without the presence of TNF as electron acceptor. In each solution tested, the organic solvent chosen was tetrahydrofuran (THF). As noted previously herein, the Charge Transfer Formation Test was carried out by observing whether or not a new absorption band appeared as the particular donor tested was admixed together with a standard solution of TNF in tetrahydrofuran. The appearance of such a new absorption band was detected in this example by observing whether or not a visual color change occurred. Due to the specific colors of the individual donor and TNF solutions tested in this example, such a color change was adequate to identify whether or not a new absorption band was formed. In some cases, however, an analysis of the absorption band spectrum of the respective donor, TNF, and mixture of donor and TNF solutions may be necessary to determine whether or not a new absorption band is present. The color of the standard TNF solution prior to admixture with donor was pale yellow. Each donor tested, the color of each donor solution prior to admixture with standard TNF solution, and the color of the resultant solvent mixture of donor solution and standard TNF solution was observed and is set forth below in Table 8. Each of the donors tested in Table 8 underwent a visual color change indicative of the presence of a new absorption band upon admixture with the standard TNF solution, thereby indicating the formation of a charge transfer complex and the utility of each of these materials as donor materials in the photoconductive compositions of the present invention.

Table 8

| Donor Tested | Color of Donor in THF | Color of TNF in THF | Color of Mixture of Donor & TNF in THF |
|---|---|---|---|
| No. 1 of Ex. 9 | colorless | pale yellow | bright yellow |
| No. 2 of Ex. 9 | colorless | pale yellow | yellow |
| No. 4 of Ex. 9 | pale yellow | pale yellow | bright yellow |
| No. 6 of Ex. 9 | colorless | pale yellow | yellow |
| No. 7 of Ex. 9 | pale yellow | pale yellow | yellow-orange |
| No. 8 of Ex. 9 | colorless | pale yellow | yellow |
| No. 9 of Ex. 9 | pale yellow | pale yellow | orange |
| No. 14 of Ex. 10 | pale yellow | pale yellow | red-orange |

EXAMPLE 14

To illustrate the importance of using a sufficient amount of the p-type organic photoconductor component in the photoconductive compositions of the invention, a series of formulations were prepared having varying amounts of p-type organic photoconductor as illustrated in Table 9 below. Each of the different formulations was coated onto a conductive layer of a polyester film support as described in Example 1A above. The light sensitivity of each formulation was then evaluated by measuring and comparing the relative sensitivity in reciprocal relative energy units (i.e., energy$^{-1}$) required to discharge these formulations from 500 to 100 volts using a blue line front exposure source. Each formulation was evaluated using both positive and negative corona charging. As can be seen from Table 9, significant increases in light sensitivity occur particularly as the amount of p-type organic photoconductor component exceeds about 10 mole percent (i.e., samples Nos. 3, 4, 5 and 6 of Table 9) based on the total amount of TNF, DBT and TTA present in each formulation.

Table 9

| Sample No. | TNF (moles) | DBT (moles) | TTA (moles) | Relative Sensitivity Negative Charging | Positive Charging |
|---|---|---|---|---|---|
| 1 | 1.0 | 1.0 | 0 | 1.0* | 1.0* |
| 2 | 1.0 | 1.0 | 0.1 | 5.0 | 2.3 |
| 3 | 1.0 | 1.0 | 0.2 | 28.0 | 4.5 |
| 4 | 1.0 | 1.0 | 0.4 | 40.0 | 10 |
| 5 | 1.0 | 1.0 | 1.0 | 130 | 25 |

Table 9-continued

| Sample No. | TNF (moles) | DBT (moles) | TTA (moles) | Relative Sensitivity Negative Charging | Relative Sensitivity Positive Charging |
|---|---|---|---|---|---|
| 6 | 1.0 | 1.0 | 1.8 | 43 | 43 |

*Arbitrarily assigned a relative value of 1.0 $cm^2$/erg for ease of comparison.

The invention has been described in detailed with particular reference to certain preferred embodiments thereof, but it will be understood that variations and modifications can be effected within the spirit and scope of the invention.

I claim:

1. A photoconductive insulating composition comprising (a) one or more p-type organic photoconductor components and (b) a charge-transfer complex of one or more electron acceptor components and one or more electron donor components; the amount of each of said photoconductor, electron acceptor, and electron donor components being within the range of from about 10 to about 65 mole percent based on the total amount of said components present in said photoconductive composition; and the electron donor components present in said composition being selected from materials having one of the following formulas:

I.

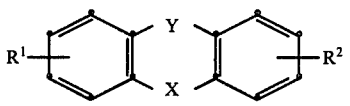

II.

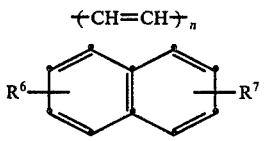

III.

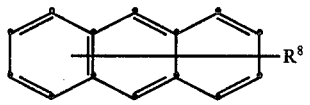

wherein

*n* represents 0, 1, or 2; X represents oxygen, sulfur, selenium or the group $>CR^3R^4$ or $>C{=}CR^5R^6$; Y represents a single covalent chemical bond or the necessary carbon and hydrogen atoms to complete a 6 to 9 member saturated or unsaturated ring; and each of $R^1$ through $R^8$ represents a substituent group such that the resultant material forms a charge-transfer complex with 2,4,7-trinitro-9-fluorenone.

2. A photoconductive insulating composition according to claim 1 wherein said electron acceptor is a monomeric material.

3. A photoconductive insulating composition according to claim 1 wherein said electron acceptor is a monomeric material selected from the group consisting of 2,4,7-trinitro-9-fluorenone; 2,4,5,7-tetranitro-9-fluorenone; 9-dicyanomethylene-2,4,7-trinitrofluorene; 1,3,7-trinitrodibenzothiophene sulfone; 3,7-di-nitrobenzothiophene sulfone; 3,3',5-trinitrobenzophenone; tetracyanopyrazine; 2,6,8-trinitro-4H-inden(1,2-b)thiophen-4-one; tetracyanopyrazine; and carboxy 9-dicyanomethylene nitrofluorenes.

4. A photoconductive insulating composition according to claim 1 wherein said p-type organic photoconductor is a monomeric organic photoconductor selected from the class consisting of arylamine, poly-arylalkane and pyrrole organic photoconductors.

5. A photoconductive insulating composition according to claim 1 wherein said p-type organic photoconductor is a monomeric arylamine-containing organic photoconductor.

6. A photoconductive insulating composition according to claim 1 wherein said p-type organic photoconductor is tris(p-tolyl)amine.

7. A photoconductive insulating composition according to claim 1 wherein said p-type organic photoconductor is a poly-arylalkane organic photoconductor having the following formula:

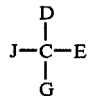

wherein each of D and G, which may be the same or different, represent aryl groups and each of J and E, which may be the same or different, represent a hydrogen atom, an alkyl group, or an aryl group, at least one of D, E and G containing an amino substituent.

8. A photoconductive insulating composition according to claim 1 wherein said electron donor is dibenzothiophene.

9. A photoconductive insulating composition according to claim 1 wherein said composition contains an electrically insulating binder.

10. A multi-active photoconductive element comprising a charge-generating layer and a charge-transport layer in electrical contact with said charge-generating layer, said charge-generating layer being a photoconductive insulating composition as defined in claim 1.

11. In a multi-phase aggregate photoconductive composition comprising a continuous, electrically insulating binder phase containing dispersed therein a particulate, co-crystalline complex of (1) a pyrylium-type dye salt and (2) a polymer having an alkylidene diarylene group in a recurring unit thereof, the improvement which comprises incorporating in the continuous, electrically insulating binder phase thereof a photoconductive insulating composition as defined in claim 1.

12. A photoconductive insulating element comprising an electrically conductive support bearing a photoconductive insulating composition according to claim 1.

13. A photoconductive insulating composition comprising (a) an electrically insulating binder, (b) one or more p-type arylamine and/or one or more p-type poly-arylalkane organic photoconductor components, and (c) a charge-transfer complex of one or more electron acceptor components and one or more electron donor components; the amount of each of said photoconductor, electron acceptor, and electron donor components being within the range of from about 10 to about 65 mole percent based on the total amount of said components present in said photoconductive composition; and at least one of the electron donor components present in said composition having the following formula:

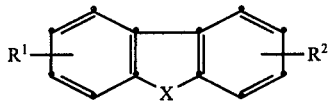

wherein each of $R^1$ and $R^2$, which may be the same or different represent hydrogen, halogen, or nitro and X represents sulfur, oxygen, or a group having one of the following formulas: $>CR^3R^4$ and $>C{=}CR^5R^6$ wherein $R^3$, $R^4$ and $R^5$ represent hydrogen and $R^6$ represents a nitro-substituted aryl.

14. A photoconductive insulating composition according to claim 13 wherein said electron donor is dibenzothiophene.

15. A photoconductive insulating composition according to claim 13 wherein said electron donor is dibenzothiophene and said electron acceptor is 2,4,7-trinitro-9-fluorenone.

16. A photoconductor insulating composition comprising (a) an electrically insulating binder, (b) one or more p-type arylamine and/or one or more p-type polyarylalkane organic photoconductor components, and (c) a charge-transfer complex of one or more electron acceptor components and one or more electron donor components; the amount of each of said photoconductor, electron acceptor, and electron donor components being within the range of from about 10 to about 65 mole percent based on the total amount of said components present in said photoconductive composition; and at least one of the electron donor components present in said composition having the following formula:

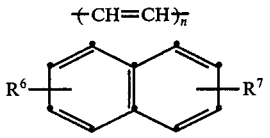

wherein $R^6$ and $R^7$ represent hydrogen and $n$ represents 0 or 1.

17. A photoconductive insulating composition comprising (a) an electrically insulating binder, (b) one or more p-type arylamine and/or one or more p-type polyarylalkane organic photoconductor components, and (c) a charge-transfer complex of one or more electron acceptor components and one or more electron donor components; the amount of each of said photoconductor, electron acceptor, and electron donor components being within the range of from about 10 to about 65 mole percent based on the total amount of said components present in said photoconductive composition; and at least one of the electron donor components present in said composition being selected from materials having the following formula:

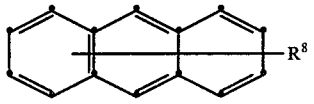

wherein $R^8$ represents a nitro, cyano, or lower alkyl group having 1 to about 4 carbon atoms.

18. A photoconductive insulating composition comprising (a) an electrically insulating binder, (b) one or more p-type arylamine and/or one or more p-type polyarylalkane organic photoconductor components, and (c) a charge-transfer complex of one or more electron acceptor components and one or more electron donor components; the amount of each of said photoconductor, electron acceptor, and electron donor components present being within the range of from about 10 to about 65 mole percent based on the total amount of said components present in said photoconductive composition; and at least one of the electron donor components present in said composition having the following formula:

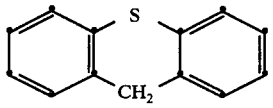

* * * * *